US006090270A

United States Patent [19]

Gildert

[11] Patent Number: 6,090,270

[45] Date of Patent: Jul. 18, 2000

[54] INTEGRATED PYROLYSIS GASOLINE TREATMENT PROCESS

[75] Inventor: Gary R. Gildert, Houston, Tex.

[73] Assignee: Catalytic Distillation Technologies, Pasadena, Tex.

[21] Appl. No.: 09/235,967

[22] Filed: Jan. 22, 1999

[51] Int. Cl.[7] ..... C10G 45/00

[52] U.S. Cl. ..... 208/57; 208/58; 208/59; 208/96; 208/97; 208/210; 208/211; 208/212; 208/213; 208/217

[58] Field of Search ..... 208/57, 58, 59, 208/96, 97, 210, 211, 212, 213, 217

[56] References Cited

U.S. PATENT DOCUMENTS

| | | | |
|---|---|---|---|
| 3,451,922 | 6/1969 | Parker | 208/57 |
| 3,470,085 | 9/1969 | Parker | 208/57 |
| 3,537,981 | 11/1970 | Parker | 208/57 |
| 3,625,879 | 12/1971 | Horne et al. | 208/68 |
| 4,115,247 | 9/1978 | Lehman et al. | 208/62 |
| 5,198,099 | 3/1993 | Trachte et al. | 208/89 |
| 5,347,061 | 9/1994 | Harandi et al. | 585/323 |
| 5,401,386 | 3/1995 | Morrison et al. | 208/65 |
| 5,510,568 | 4/1996 | Hearn . | |
| 5,595,634 | 1/1997 | Hearn et al. . | |
| 5,597,476 | 1/1997 | Hearn et al. . | |
| 5,679,241 | 10/1997 | Morrison et al. | 208/65 |
| 5,685,972 | 11/1997 | Timken et al. | 208/89 |
| 5,779,883 | 7/1998 | Hearn et al. . | |
| 5,807,477 | 9/1998 | Hearn et al. . | |
| 5,877,363 | 3/1999 | Gildert et al. . | |

FOREIGN PATENT DOCUMENTS

WO 95/15934 6/1995 WIPO .

*Primary Examiner*—Walter D. Griffin
*Assistant Examiner*—Nadine Preisch
*Attorney, Agent, or Firm*—Kenneth H. Johnson

[57] ABSTRACT

An integrated process for treating pyrolysis gasolines by depentanizing the pyrolysis gasoline in a first distillation column reactor which also subjects the $C_5$ fraction to selective hydrogenation of acetylenes and diolefins. The bottoms or $C_6$+ material is then subjected to further distillation in a second distillation column reactor to remove either a $C_6$ and lighter or $C_8$ and lighter overheads which contains a benzene/toluene/xylene (BTX) concentrate while at the same time removing mercaptans and selectively hydrogenating the diolefins. The BTX concentrate is then subjected to hydrodesulfurization prior to aromatics extraction and separation of the benzene from the toluene and xylene. Concurrently with the benzene separation any remaining olef ins are saturated to remove the color bodies. Finally the heavy gasoline fraction is subjected to the concurrent catalytic removal of mercaptans and separation to remove the heaviest material.

10 Claims, 7 Drawing Sheets

INTEGRATED PYROLYSIS GASOLINE TREATMENT PROCESS

BACKGROUND OF THE INVENTION

1. Field of the Invention

The present invention relates to a process for the processing of pyrolysis gasoline. More particularly the invention relates to a separation of the pyrolysis gasoline into commercially attractive fractions and treating the fractions to remove or convert unwanted contaminants. More particularly the invention relates to an integrated process wherein the separations are carried out concurrently with a specific treatment in distillation column reactors containing the appropriate catalysts.

2. Related Art

Pyrolysis gasoline is a gasoline boiling range (~97–450° F.) petroleum stock obtained as a product or by-product from a process in which thermal processing is used to crack a petroleum stock. One example is the destructive cracking of a naphtha boiling range material to produce ethylene. Another example is the delayed coking of a residual petroleum stock to produce lighter components, including coker gasoline.

Products from these thermal cracking processes contain high concentrations of olefinic materials as well as saturated (alkanes) materials and polyunsaturated materials (diolefins). Additionally, these components may be any of the various isomers of the compounds. In addition the gasoline boiling range material contains considerable amounts of aromatic compounds.

The pyrolysis gasolines are typically processed to removed unwanted acetylenes, diolefins and sulfur compounds. Some of the diolefins may be recovered, especially isoprene.

The $C_5$'s are recovered and are useful in isomerization, etherification and alkylation. As noted above, isoprene is also recovered as a useful product. Normally, however, the diolefins are removed along with acetylenes by selective hydrogenation. If desired the $C_5$'s may be completely hydrogenated and returned to the naphtha cracker ethylene plant as recycle.

The $C_6$ and heavier fractions contain sulfur compounds which are usually removed by hydrodesulfurization. The aromatic compounds are often removed and purified by distillation to produce benzene, toluene and xylenes. The aromatic containing fraction is often treated with clay material to remove olefinic material.

Finally the heavy boiling gasoline is normally treated by caustic treating to remove the mercaptans and olefins prior to being used as a gasoline blending stock. In the present refinery scheme many of the separate steps and processes of the prior art are combined into single multifunctional catalytic distillation columns.

SUMMARY OF THE INVENTION

Briefly the present invention is an integrated process for treating pyrolysis gasolines wherein the pyrolysis gasoline is first depentanized in a first distillation column reactor which also removes mercaptans and subjects the $C_5$ fraction to selective hydrogenation of acetylenes and diolefins. The bottoms or $C_6$+ material is then subjected to further distillation in a second catalytic distillation tower which removes mercaptans boiling in the range of $C_6$–$C_8$'s by catalytic addition to dienes with hydrogenation of the remaining dienes in the $C_6$–$C_8$ stream as it is distilled overhead. The bottoms recovered from the second tower are sent forward to a degum tower which contains a hydrogenation catalyst distillation structure in order to hydrogenate dienes and stabilize the 400° F. end point gasoline recovered overhead. The bottoms from the degum tower are used as cutter stock.

The $C_6$–$C_8$ overhead stream from the second tower contains BTX (benzene, toluene and xylenes). This stream is subjected to hydrodesulfurization prior to extraction of the BTX in order to remove thioethers. The destructive hydrodesulfurization is carried out in a catalytic distillation tower, removing $H_2S$ overhead and $C_6$–$C_8$ stream containing the BTX as bottoms.

The BTX can be separated by extraction or by extractive distillation. Selective hydrogenation of this aromatic stream is carried out in another catalytic distillation tower to remove traces of olefins and color from the BTX while separating benzene overhead from toluene and xylene bottoms. The raffinate from the extraction (a clean $C_6$–$C_8$ aliphatic stream) can be blended into gasoline.

The term "reactive distillation" is used to describe the concurrent reaction and fractionation in a column. For the purposes of the present invention, the term "catalytic distillation" includes reactive distillation and any other process of concurrent reaction and fractional distillation in a column regardless of the designation applied thereto.

DESCRIPTION OF THE PREFERRED EMBODIMENTS

Figure 1:
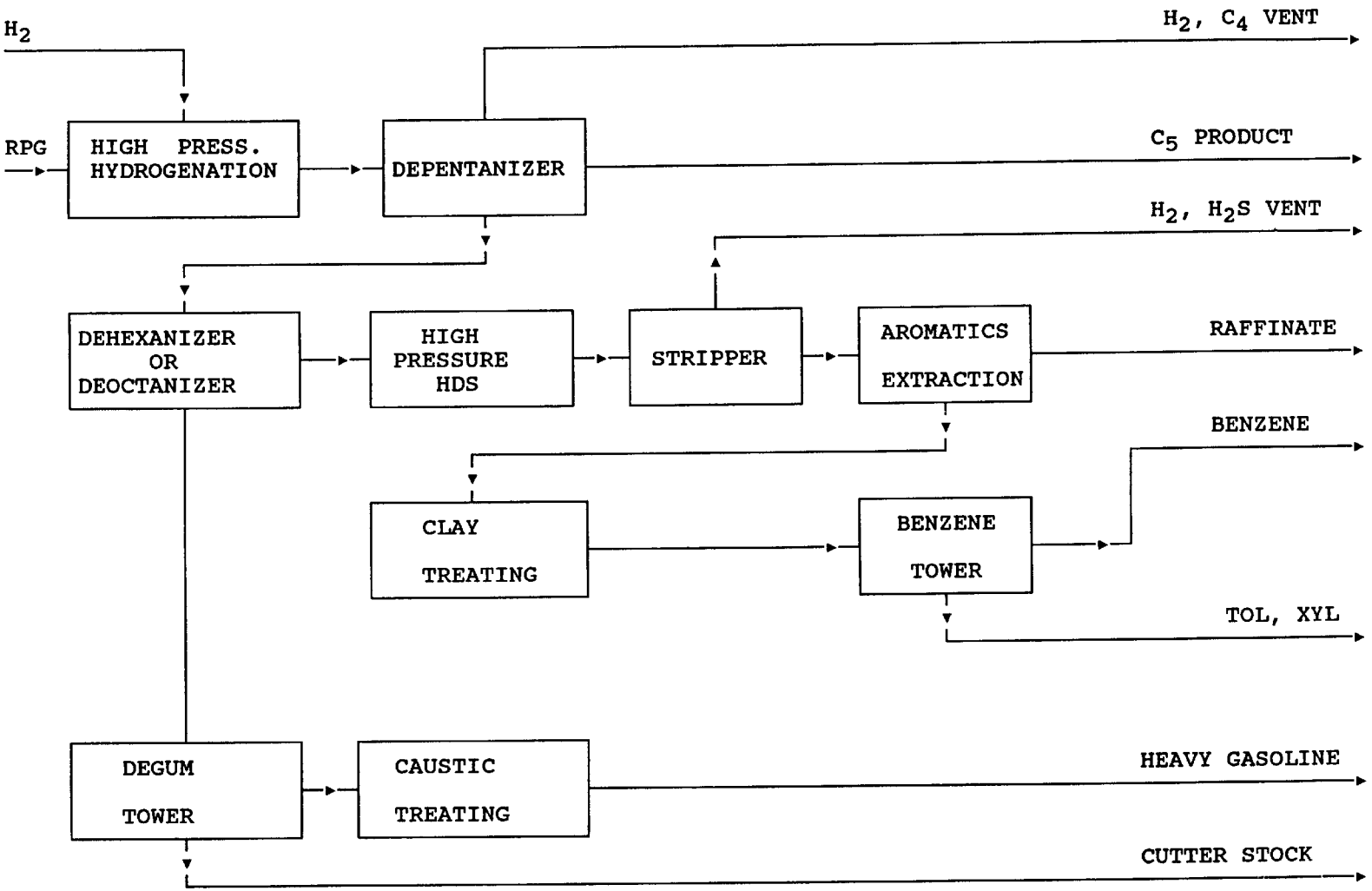
FIG. 1 PRIOR ART
FIG. 1 is a block flow diagram of a typical prior art pyrolysis gasoline treatment scheme.

Referring first to FIG. 1 there is shown a block flow diagram of a typical prior art pyrolysis gasoline treatment scheme. The pyrolysis gasoline (RPG) in the prior art is first subjected to a high pressure hydrogenation process to saturate all of the acetylenes and diolefins. The effluent from the hydrogenation is then passed to a depentanizer to separate the $C_4$'s and lighter products from the $C_6$ and heavier. Depending upon the aromatic compounds to be recovered, the $C_6$ and heavier product is then passed to a dehexanizer if only benzene is to be recovered or a deoctanizer if toluene ($C_7$) and xylenes ($C_8$'s) are also to be recovered The aromatic rich cut must then be subjected to hydrodesulfurization and stripping prior to aromatic extraction. The final aromatic stream must still be clay treated to remove any traces of olefins left prior to distillation to separate the aromatics into the desired "pure" components.

The $C_9$'s and heavier must be distilled to remove any high boiling "gum" products which are typical of the pyrolysis gasolines. The heavy gasoline product must then be caustic treated to remove mercaptans prior to use as a gasoline blending component.

Each step in the conventional pyrolysis must be carried out in separate vessels or reactors, some of which must be specialized for processing the stream. A total of at least ten vessels or reactors must be used.

Figure 2:
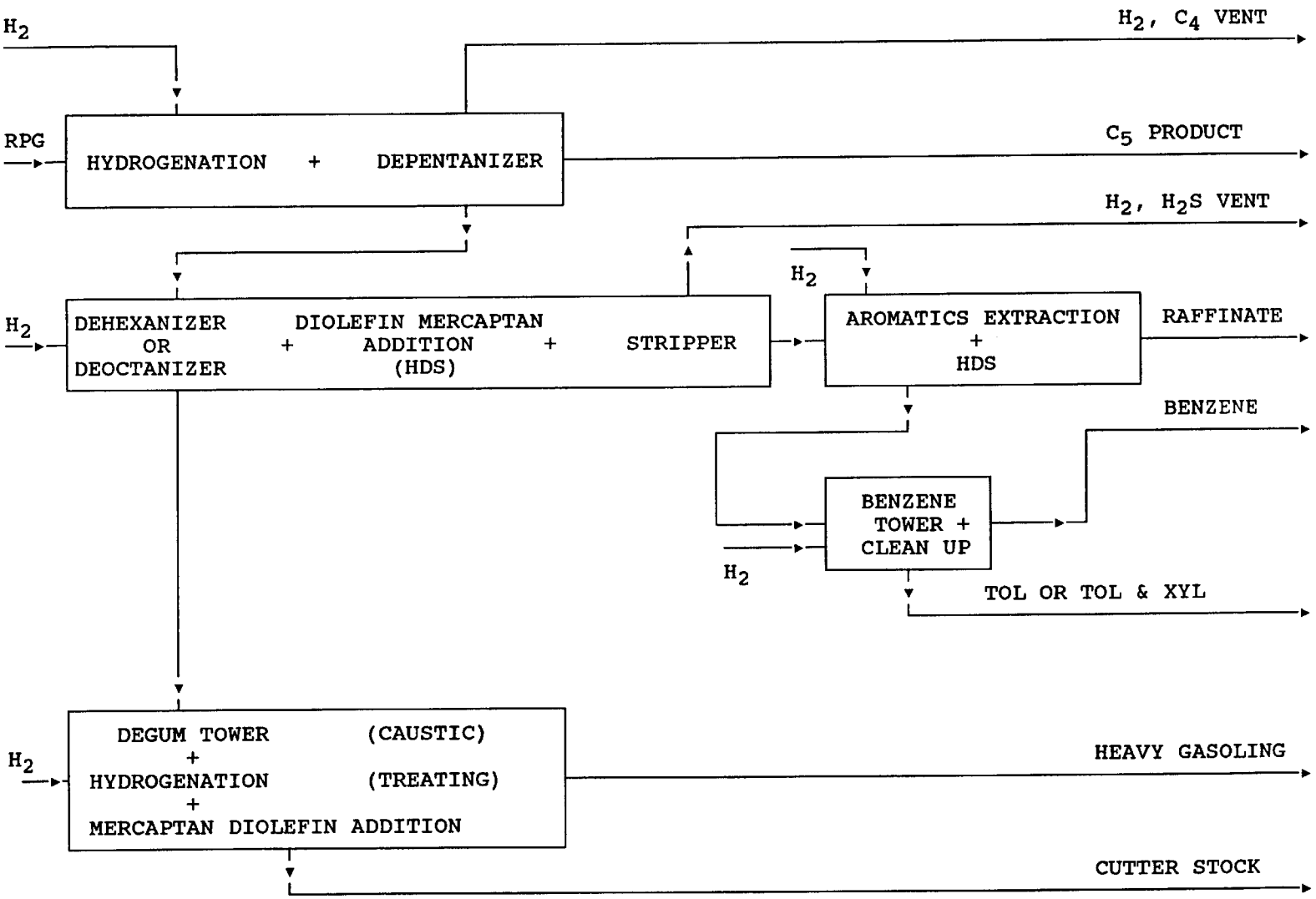
FIG. 2 is a block flow diagram of the pyrolysis gasoline treatment scheme of the present invention.

Referring now to FIG. 2 a block flow diagram of the pyrolysis gasoline treatment scheme of the present invention is shown to be much simpler and to utilize only half as many vessels or reactors. The hydrogenation is carried out in the depentanizer and because of the characteristics described below the pressures are much lower than that necessary in conventional hydrogenation processes for the same feed stock. Also placement of the catalyst bed in the upper half of the depentanizer bed allows for selective hydrogenation of the $C_5$ and lighter portion only. Also, instead of the high pressure hydrodesulfurization of the entire stream the mercaptans are removed from the $C_6$–$C_8$ fraction in the upper end of the dehexanizer/deoctanizer. The pressure in this combined reactor distillation column is also much lower than that of conventional reactors.

The aromatics are simultaneously concentrated and desulfurized in another distillation column reactor. Similarly the benzene can be separated from the toluene and xylenes and the olefins hydrogenated in the same vessel.

Finally the degum tower may be used to remove the mercaptans and diolefins in lieu of caustic treating.

The concurrent reaction and separation of products has been referred to as catalytic distillation or reactive distillation. In earlier adaptations the distillation was designed specifically to separate the reaction products from reactants to improve yield and selectivity. However, it has now been found that the boiling and condensing in a distillation column is very conducive to reactions requiring hydrogen. For example hydrodesulfurization may be carried out in a distillation column reactor with the product $H_2S$ being separated because of its low boiling point. Hydrogenations may also be advantageously carried out in distillation column reactors.

The operation of the distillation column reactor results in both a liquid and vapor phase within the distillation reaction zone. A considerable portion of the vapor is hydrogen while a portion is vaporous hydrocarbon from the petroleum fraction. Within the distillation reaction zone there is an internal reflux and liquid from an external reflux which cools the rising vaporous hydrocarbon condensing a portion within the bed.

Without limiting the scope of the invention it is proposed that the mechanism that produces the effectiveness of the present hydrotreating is the condensation of a portion of the vapors in the reaction system which occludes sufficient hydrogen in the condensed liquid to obtain the requisite intimate contact between the hydrogen and the sulfur compounds, olefins, diolefins and the like, in the presence of the catalyst to result in their hydrogenation.

The result of the operation of the process in the catalytic distillation mode is that lower hydrogen partial pressures (and thus lower total pressures) may be used. As in any distillation there is a temperature gradient within the distillation column reactor. The temperature at the lower end of the column contains higher boiling material and thus is at a higher temperature than the upper end of the column. This allows for standard petroleum distillation processes to be conducted such as stripping (removal of $C_4$ and lighter as overheads), depentanizing (removal of $C_5$'s as overheads) and others while carrying out the desired reactions within a single column.

The catalytic material is preferably a component of a distillation system functioning as both a catalyst and distillation packing, i.e., a packing for a distillation column having both a distillation function and a catalytic function, however, the present integrated refinery may also use such systems as described in U.S. Pat. Nos. 5,133,942; 5,368,691; 5,308,592; 5,523,061; and European Patent Application No. EP 0 755 706 A1.

The reaction system can be described as heterogenous since the catalyst remains a distinct entity. A preferred catalyst structure for the present hydrogenation reaction comprises flexible, semi-rigid open mesh tubular material, such as stainless steel wire mesh, filled with a particulate catalytic material in one of several embodiments recently developed in conjunction with the present process.

Of particular interest is the structured packing disclosed and claimed in U.S. Pat. No. 5,730,843 which is incorporated herein in its entirety. Other catalyst structures useful in the present refinery scheme are described in U.S. Pat. Nos. 5,266,546; 4,242,530; 4,443,559; 5,348,710; 4,731,229 and 5,073,236 which are also incorporated by reference.

The particulate catalyst material may be a powder, small irregular chunks or fragments, small beads and the like. The particular form of the catalytic material in the structure is not critical so long as sufficient surface area is provided to allow a reasonable reaction rate. The sizing of catalyst particles can be best determined for each catalytic material (since the porosity or available internal surface area will vary for different material and, of course, affect the activity of the catalytic material).

As defined herein hydrotreating is considered to be a process wherein hydrogen is utilized to remove unwanted contaminants by 1) selective hydrogenation, 2) destructive hydrodesulfurization or 3) mercaptan-diolefin addition in the presence of hydrogen.

Catalysts which are useful in all the reactions described herein include metals of Group VII of the Periodic Table of Elements. Catalysts preferred for the selective hydrogenation of acetylenes and diolefins are alumina supported palladium catalysts. Catalysts preferred for the hydrodesulfurization reactions include Group VIII metals such as cobalt, nickel, palladium, alone or in combination with other metals such as molybdenum or tungsten on a suitable support which may be alumina, silica-alumina, titania-zirconia or the like. The preferred catalyst for the mercaptan/diolefin reaction is a high nickel content (up to 58 wt %) alumina supported extrudate.

Generally the metals are deposited as the oxides on extrudates or spheres, typically alumina. The catalyst may then be prepared as the structures described above.

In FIG. 2 the overall flow scheme of the present integrated process is outlined. The feed comprises pyrolysis gasoline which is a complex mixture of predominately hydrocarbon paraffins, naphthenics and aromatics boiling in the range of 97 to 450° F. Typical pyrolysis gasolines may contain: 4–30% aromatics, 10–30% olefins, 35–72% paraffins and 1–20% unsaturated containing trace amounts of sulfur, oxygen and/or nitrogen organic compounds. The hydrocarbons are principally $C_4$-$C_9$ alkanes, olefins, diolefins, acetylenes, benzene, toluene and xylenes and some heavier residuum.

In one embodiment the pyrolysis gas may be pretreated to remove mercaptans and $H_2S$ by washing with alkaline water, or $H_2S$ may be removed with the $C_4$ fraction and mercaptans boiling in the $C_5$ range may be removed in the bottom section of depentanizer tower by catalytic addition with dienes. The remaining dienes and acetylenes are hydrogenated in the upper section of the tower and the hydrotreated $C_5$ and lighter material taken overhead via line 103.

In various steps of the present integrated process these fractions are separated and recovered while the sulfur, oxygen and nitrogen compounds, acetylenes, diolefins and optionally olefins are reduced or eliminated. The relationship of the specific units shown in FIGS. 3–7 is shown by referencing the blocks of the flow scheme to the figures.

Figure 3:
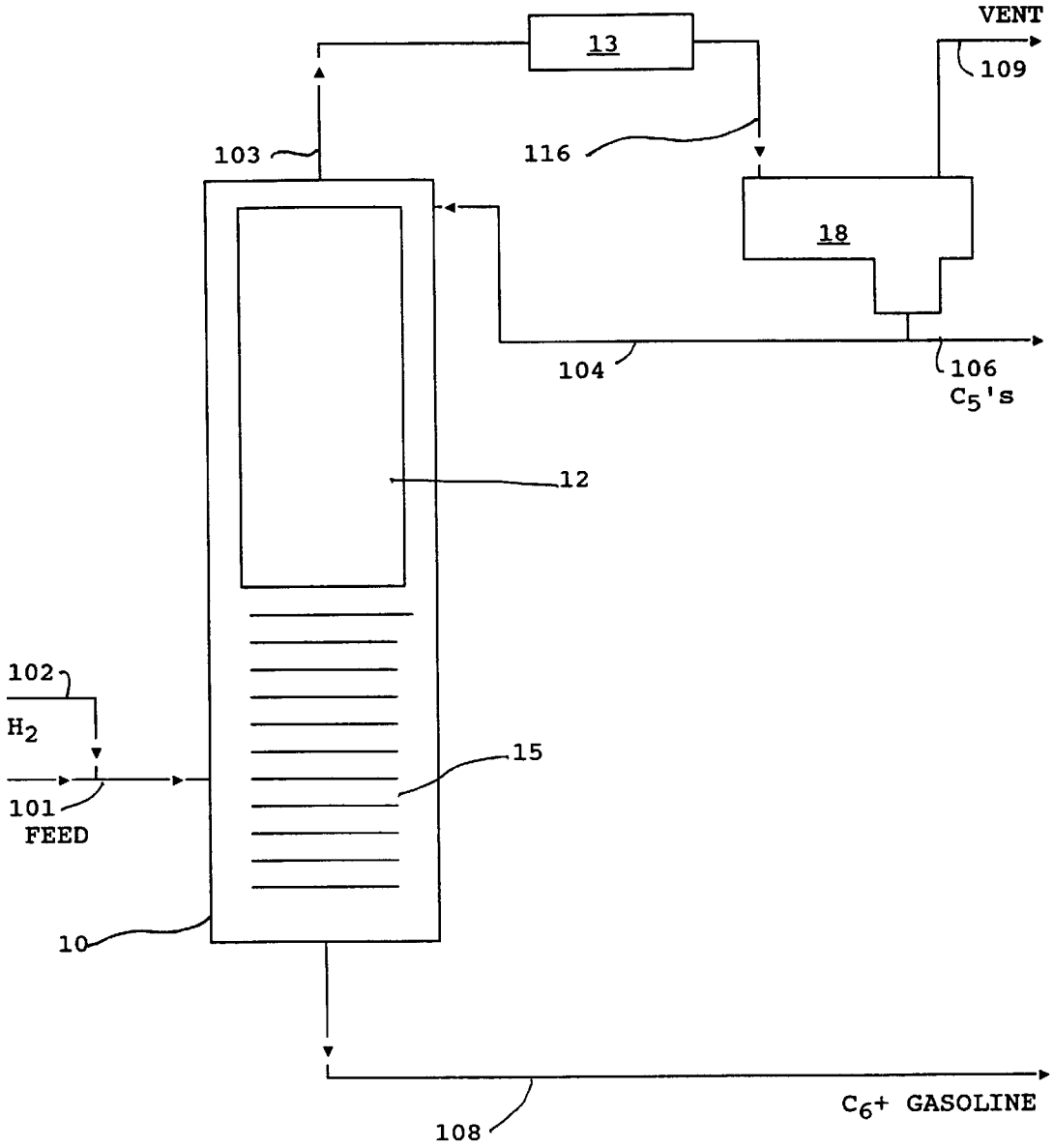
FIG. 3 is a flow diagram in schematic form of a depentanizer as used in the present invention.

Turning now to the specific processes within the scheme, FIG. 3 presents a flow diagram in schematic form of a combined depentanizer/hydrogenation reactor 10 as used in the present invention. The depentanizer/reactor 10 is shown to include a bed 12 of hydrogenation catalyst in the form of a catalytic distillation structure and a stripping section 15 below the bed 12. The pyrolysis gasoline is fed via flow line 101 and hydrogen fed by flow line 102, both into the stripping section 15. The $C_5$'s and lighter are boiled upward into the catalyst bed 12 where the acetylene and diolefins are selectively hydrogenated to more useful products. The hydrogenated $C_5$ and lighter material is taken overhead via flow line 103 and the condensible materials condenses in partial condenser 13. The condensed liquid is collected in receiver 18 where it is also separated from vapors including unreacted hydrogen which may be recycled. The liquid product is removed from the receiver and a portion is returned via flow line 104 to the depentanizer/reactor as reflux. Product is taken via flow line 106 while the vapors are removed via flow line 109. Bottoms material containing the $C_6$ and heavier components is removed via flow line 108. Any $C_5$ boiling mercaptans are taken along with the remainder of the $C_5$ product.

Figure 4:
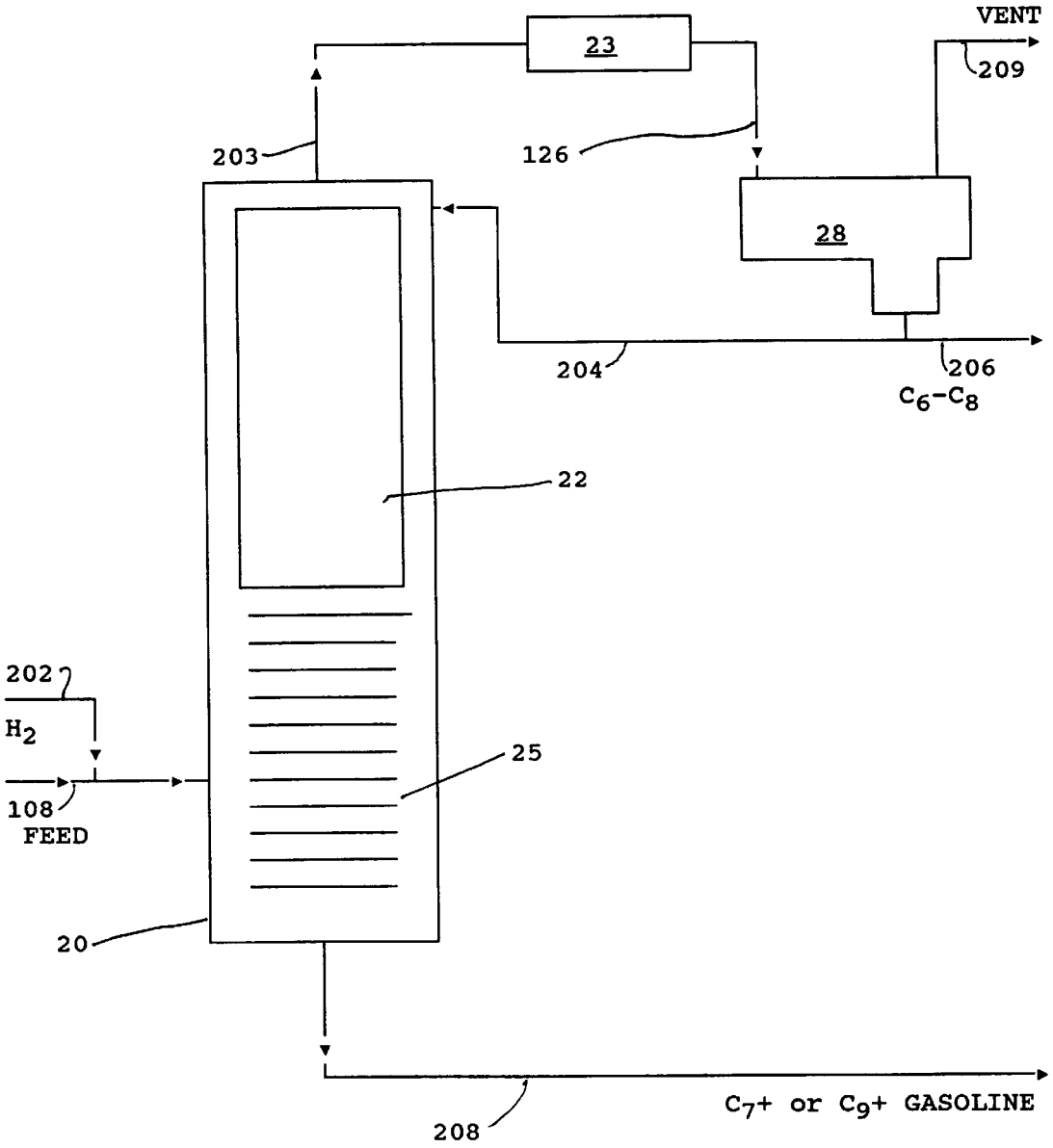
FIG. 4 is a flow diagram in schematic form of a dehexanizer/deoctanizer as used in the present invention.

Referring now to FIG. 4 a combination dehexanizer or deoctanizer/hydrotreater reactor for processing the $C_6$ and heavier and material from the depentanizer 10. For illustration purposes the present processing scheme utilizes a deoctanizer 20 containing a bed 22 of suitable hydrotreating catalyst in the upper end and a stripping section 25 containing standard distillation structures such as sieve trays, bubble cap trays or the like. The bottoms from the depentanizer 10 in flow line 108 are combined with hydrogen from flow line 202 and fed into the deoctanizer/hydrotreater into the stripping section 25. The $C_8$ and lighter material are boiled up into the catalyst bed wherein a considerable amount of the mercaptans are reacted with diolefins to form sulfides. The sulfides are higher boiling material and are removed along with the $C_9$ and heavier materials as bottoms via flow line 208. The $C_8$ and lighter material along with unreacted hydrogen is taken as overheads via flow line 203 where the condensible material is condensed in partial condenser 23 and collected in receiver 28. The uncondensed vapors are separated from the liquids in the receiver and removed via flow line 209. The $C_6$–$C_8$ material is removed via flow line 206. A portion of the $C_6$–$C_8$ material is returned to the deoctanizer/desulfurizer as reflux via flow line 204. The heavy gasoline is removed as bottoms via flow line 208 for further treatment.

Figure 5:
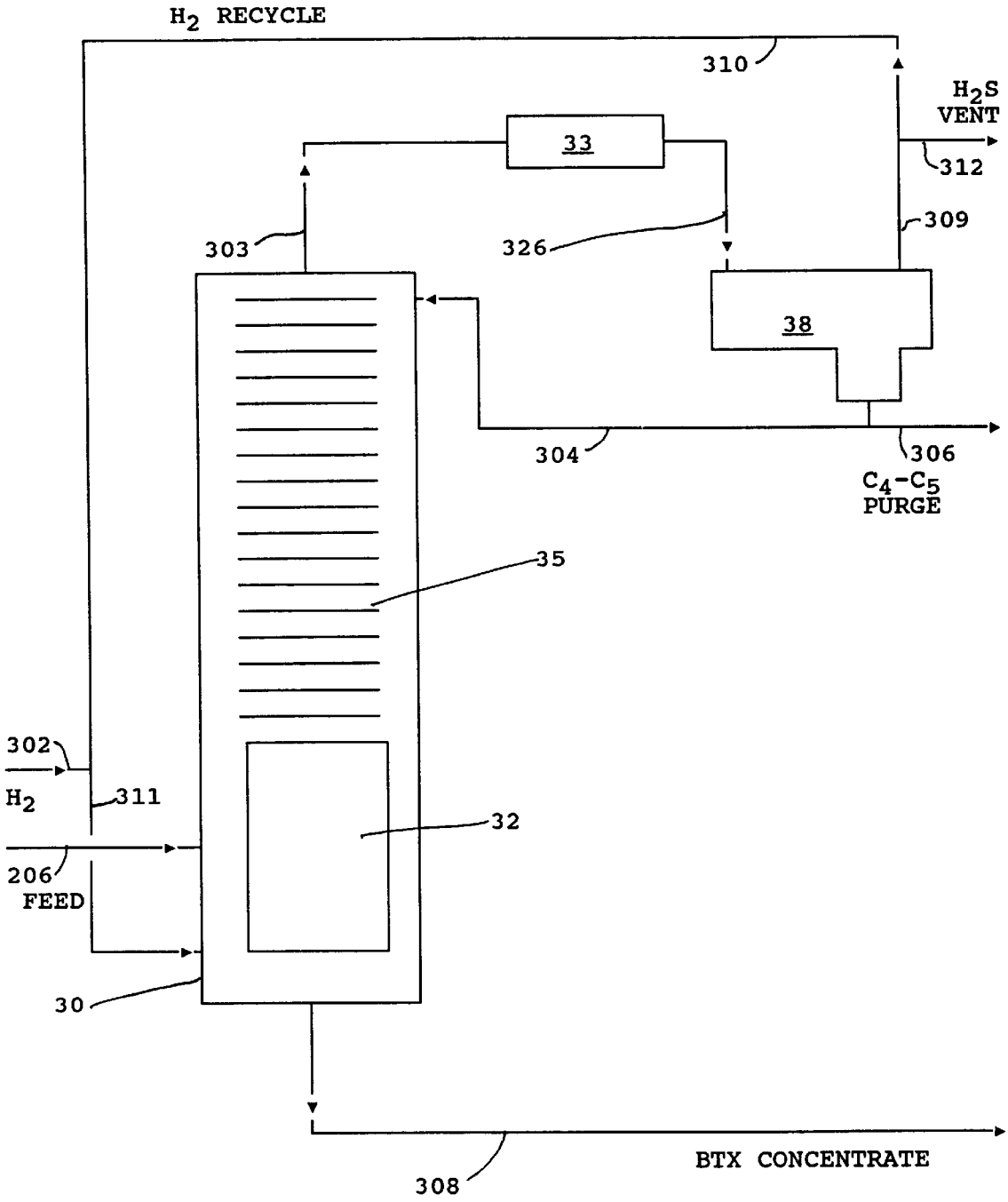
FIG. 5 is a flow diagram in schematic form of a hydrodesulfurization process for treating the $C_6$–$C_8$ fraction in the present invention.

Referring now to FIG. 5 a flow diagram in schematic form of a hydrodesulfurization process for treating the $C_6$–$C_8$ fraction from column 20 is shown. The distillation column reactor 30 is shown to contain a bed of suitable catalyst 32 in the stripping section and conventional distillation structure in the rectification section 35. The $C_6$–$C_8$ is fed via flow line 206 into the middle of the bed 32 and hydrogen in flow line 302 is combined with recycle hydrogen from flow line 310 and fed via flow line 311 below the bed 32. The stripping section removes the $H_2S$ and other $C_5$ and lighter products of cracking from the aromatic concentrate as overheads via flow line 303. The $C_4$'s and $C_5$'s are condensed in partial condenser 33 and collected in receiver 38 where they are separated from the unreacted hydrogen and $H_2S$. The $C_4$'s and $C_5$'s are removed as products via flow line 306 with a portion being returned to the distillation column reactor 30 as reflux via flow 304. A vent for $H_2S$ is provided as flow line 312 while the unreacted hydrogen is recycled via flow line 310. If desired the recycle hydrogen may be scrubbed to remove the $H_2S$ in lieu of the vent. The aromatic (BTX) concentrate is removed as bottoms via flow line 308 for aromatics extraction by standard processing such as solvent extraction using ethylene glycols as in the UDEX process.

Figure 6:
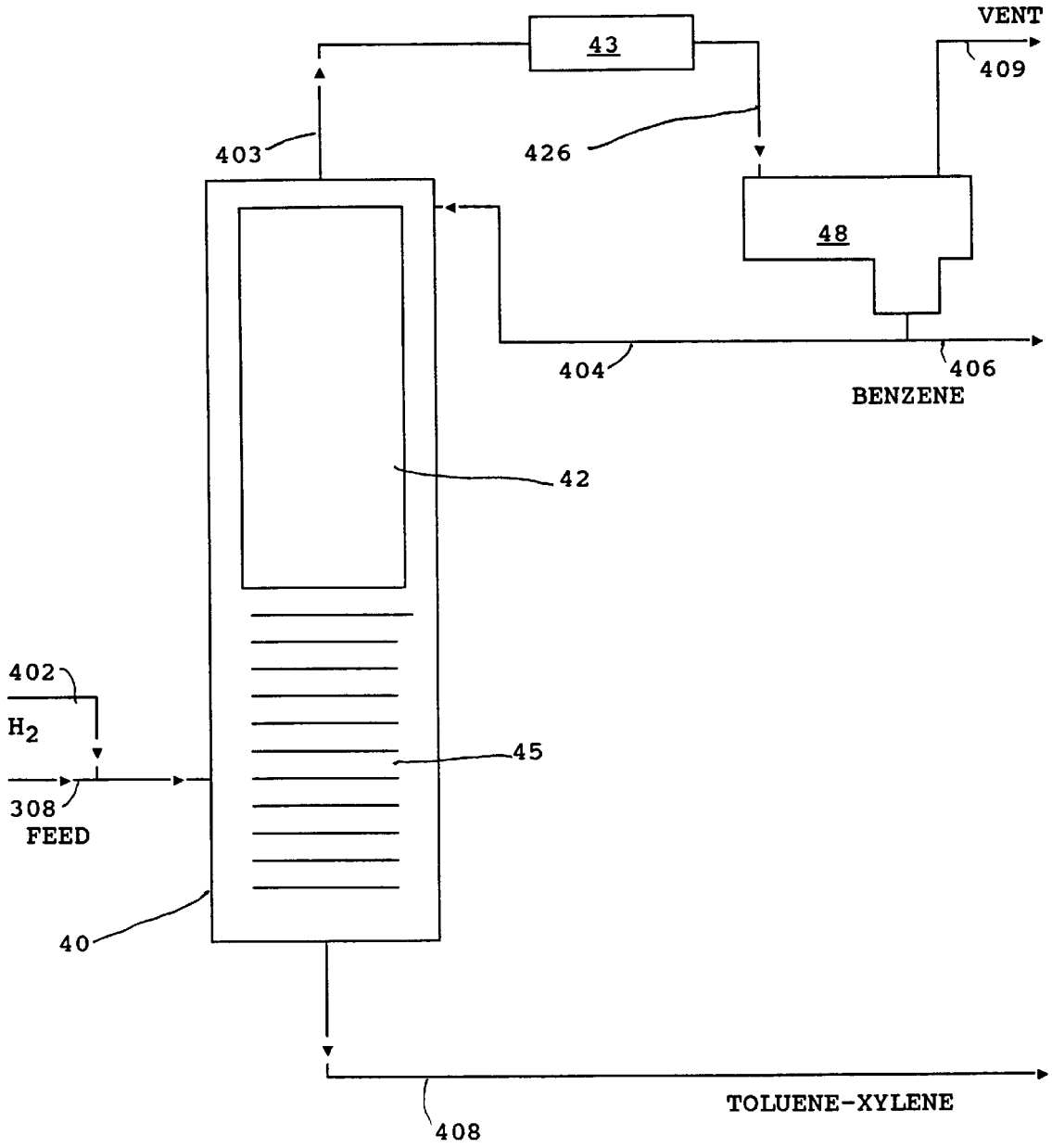
FIG. 6 is a flow diagram in schematic form of a BTX column as used in the present invention.

Referring now to FIG. 6 the treatment of the extracted aromatics is depicted. The combined aromatic stream from the extraction process in flow line 308 is fed to the combination benzene tower/treater which contains a bed 42 of suitable catalyst for olefin saturation in the form of a catalytic distillation structure in the upper end. Below the bed 42 is a stripping section 45 containing conventional distillation structure. Hydrogen is fed via flow line 402 and the combined feed enters the benzene tower/treater 12 in the middle of the stripping section. The benzene containing fraction is boiled up into the bed 42 wherein the color bodies are hydrogenated. The benzene containing fraction and unreacted hydrogen are removed as overheads via flow line 403 and passed through partial condenser 43 wherein the condensible liquids are condensed. The benzene containing liquid is collected in receiver 48 and the uncondensed vapors are separated and withdrawn via flow line 409. The benzene product is removed via flow line 406 while a portion is recycled to the tower as reflux via flow line 404. The uncondensed vapors are vented via flow line 409. The toluene and xylene containing fraction is removed as bottoms via flow line 408. The two fractions may then be individually treated to extract the desired aromatic compounds.

Figure 7:
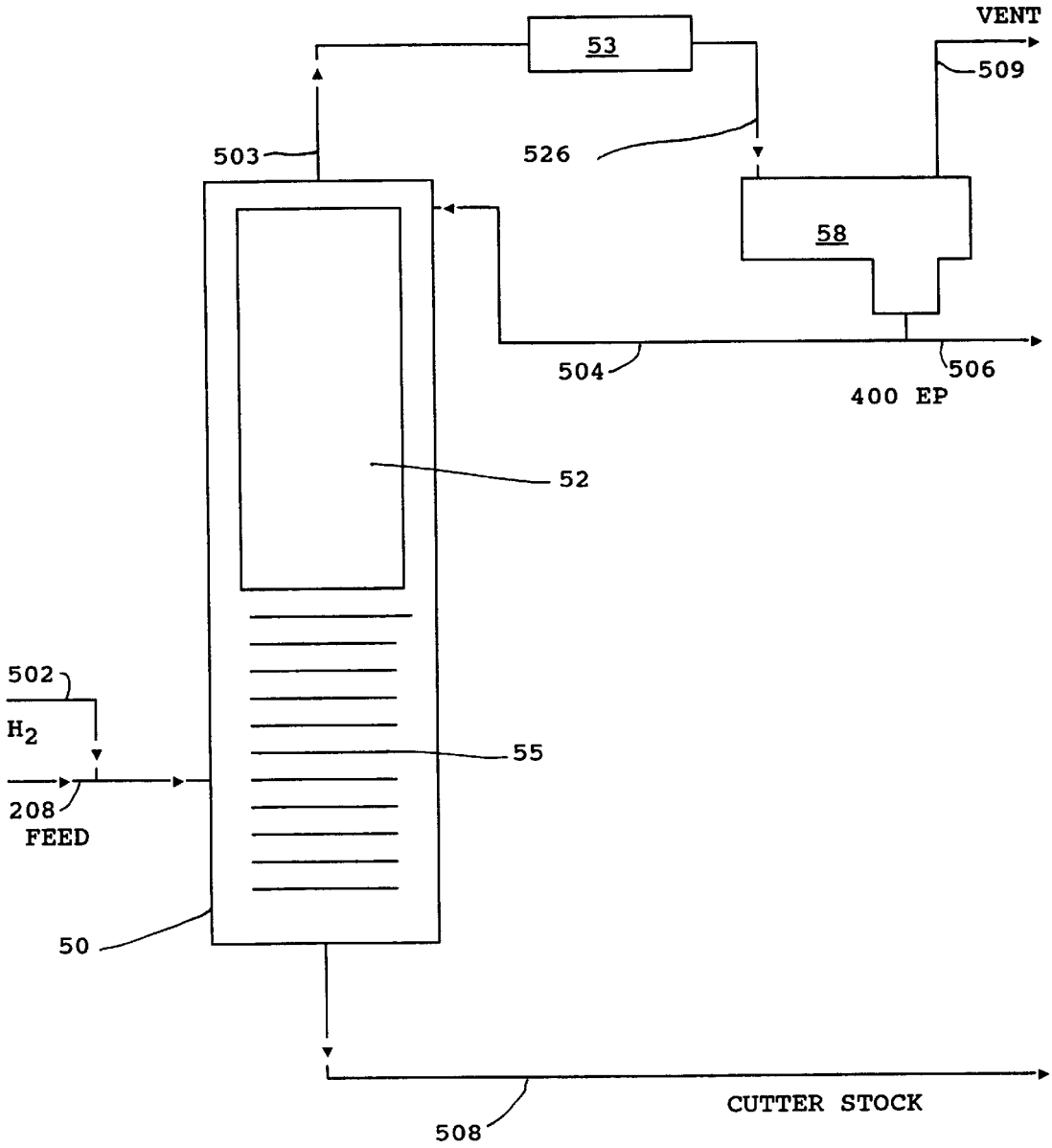
FIG. 7 is a flow diagram in schematic form of a heavy gasoline stabilization process as used in the present invention.

Finally, referring to FIG. 7, the heavy gasoline treatment is shown. The heavy gasoline in flow line 208 is fed to a combination degum tower/hydrotreater 50 which contains bed 52 of hydrotreating catalyst in the upper portion. Hydrogen is fed via flow line 502. A stripping section 55 is located below the bed for stripping all of the desirable gasoline from the heavies. The heavy gasoline or 400° F. end point material is boiled up into the bed 52 wherein the mercaptans contained therein react with the diolefins to form heavier sulfides which are removed with the bottoms via flow line 508. In addition the remaining diolefins are hydrogenated to mono olefins which are removed with the overheads along with unreacted hydrogen. The 400° F. end point gasoline is condensed in the partial condenser 53 and collected in receiver 58 where it is separated from the vapors which are vented via flow line 509.

As can be noted the combining of the several distillations with the appropriate reactors reduces the number of vessels which reduces the capital costs. In addition the combination reaction and distillation allows for much lower pressures which also reduce capital costs along with operating costs.

The invention claimed is:

1. An integrated process for the treatment of pyrolysis gasoline containing organic sulfur compounds including mercaptans, acetylenes, diolefins, olefins, benzene, toluene and xylenes, comprising the steps of:

(a) feeding the pyrolysis gasoline and hydrogen to a hydrotreater/depentanizer wherein the acetylenes and diolefins contained within the $C_5$ and lighter fraction are selectively hydrogenated concurrently with the separation of the $C_5$ and lighter fraction as a first overheads from the $C_6$ and heavier fraction as a first bottoms;

(b) feeding the first bottoms from step (a) and hydrogen to a first hydrotreater distillation column reactor wherein mercaptans contained within the $C_6$–$C_8$ fraction are selectively reacted with diolefins contained within the $C_6$–$C_8$ fraction to form sulfides and the remaining diolefins contained within the $C_6$–$C_8$ fraction are selectively hydrogenated to mono olefins concurrently with the separation of the $C_6$–$C_8$ and lighter fraction as a second overheads from the Cg and heavier fraction as a second bottoms; and (c) feeding the second bottoms from step (b) containing the $C_9$ and heavier material to a second hydrotreater distillation column reactor wherein mercaptans in the second bottoms are reacted with diolefins in the second bottoms to form sulfides while concurrently in said second hydrotreating distillation column reactor, separating the material boiling at less than 400° F. as a third overheads from the material boiling at greater than 400° F. as a third bottoms.

2. The integrated process according to claim 1 comprising the further steps of:

(d) feeding the $C_6$–$C_8$ fraction from step (b) and hydrogen to a hydrodesulfurization distillation column reactor wherein organic sulfur compounds remaining in the second overheads are reacted with hydrogen to form $H_2S$ which is removed as a fourth overheads while the $C_6$–$C_8$ fraction containing reduced organic sulfur compounds is removed as a fourth bottoms; and (e) feeding the fourth bottoms from step (d) to a benzene tower treater wherein olef ins and diolef ins are selectively hydrogenated while concurrently in said benzene tower treater, separating the fourth bottoms into an overhead stream containing benzene and a bottom stream containing toluene and xylenes.

3. The integrated process according to claim 2 wherein a catalyst independently selected from Group VIII metals is present in steps (a)–(e).

4. The integrated process according to claim 3 wherein said catalyst is incorporated in a distillation structure.

5. The integrated process according to claim 2 wherein said fourth bottoms are subjected to aromatic extraction and said extracted aromatics are fed to said benzene tower treater.

6. An integrated process for the treatment of pyrolysis gasoline containing organic sulfur compounds including mercaptans, acetylenes, diolefins, olefins, benzene, toluene and xylenes, comprising the steps of:

(a) feeding the pyrolysis gasoline and hydrogen to a hydrotreater/depentanizer wherein the acetylenes and diolefins contained within the $C_5$ and lighter fraction are selectively hydrogenated concurrently with the separation of the $C_5$ and lighter fraction as a first overheads from the $C_6$ and heavier fraction as a first bottoms;

(b) feeding the first bottoms from step (a) and hydrogen to a first hydrotreater distillation column reactor wherein mercaptans contained within the $C_6$–$C_7$ fraction are selectively reacted with diolefins contained within the $C_6$–$C_7$ fraction to form sulfides and the remaining diolefins contained within the $C_6$–$C_7$ fraction are selectively hydrogenated to mono olefins concurrently with the separation of the $C_6$–$C_7$ and lighter fraction as a second overheads from the $C_8$ and heavier fraction as a second bottoms; and (c) feeding the second bottoms from step (b) containing the $C_8$ and heavier material to a second hydrotreater distillation column reactor wherein mercaptans in the second bottoms are reacted with diolefins in the second bottoms to form sulfides while concurrently in said second hydrotreating distillation column reactor, separating the material boiling at less than 400° F. as a third overheads from the material boiling at greater than 400° F. as a third bottoms.

7. The integrated process according to claim 6 comprising the further steps of:

(d) feeding the $C_6$–$C_7$ fraction from step (b) and hydrogen to a hydrodesulfurization distillation column reactor wherein organic sulfur compounds remaining in the second overhead are reacted with hydrogen to form $H_2S$ which is removed as a fourth overheads while the $C_6$–$C_7$ fraction containing reduced organic sulfur compounds is removed a fourth bottoms; and (e) feeding the fourth bottoms from step (d) to a benzene tower treater wherein olefins and diolefins are selectively hydrogenated while concurrently in said benzene tower treater, separating the fourth bottoms into an overhead stream containing benzene and a bottom stream containing toluene.

8. The integrated process according to claim 7 wherein a catalyst independently selected from Group VIII metals is present in steps (a)–(e).

9. The integrated process according to claim 8 wherein said catalyst is incorporated in a distillation structure.

10. The integrated process according to claim 7 wherein said fourth bottoms are subjected to aromatic extraction and said extracted aromatics are fed to said benzene tower treater.

* * * * *